US008055177B2

(12) United States Patent
Lee et al.

(10) Patent No.: US 8,055,177 B2
(45) Date of Patent: Nov. 8, 2011

(54) HEATING MEMBER INCLUDING RESISTIVE HEATING LAYER AND FUSING DEVICE COMPRISING THE HEATING MEMBER

(75) Inventors: Sang-eui Lee, Yongin-si (KR); In-taek Han, Seoul (KR); Ha-jin Kim, Suwon-si (KR); Sang-soo Jee, Kimpo-si (KR); Dong-earn Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 65 days.

(21) Appl. No.: 12/605,752

(22) Filed: Oct. 26, 2009

(65) Prior Publication Data

US 2010/0260526 A1 Oct. 14, 2010

(30) Foreign Application Priority Data

Apr. 13, 2009 (KR) ..... 10-2009-0031927

(51) Int. Cl.
*G03G 15/20* (2006.01)

(52) U.S. Cl. ..... 399/333

(58) Field of Classification Search ..... 399/328, 399/330, 333; 430/124.32
See application file for complete search history.

(56) References Cited

U.S. PATENT DOCUMENTS

| | | | | |
|---|---|---|---|---|
| 5,349,423 | A * | 9/1994 | Nagato et al. | 399/333 |
| 5,900,295 | A * | 5/1999 | Kawada | 399/333 |
| 6,122,479 | A * | 9/2000 | Fujita et al. | 399/333 |
| 6,122,480 | A * | 9/2000 | Hwang | 399/328 |
| 6,226,483 | B1 | 5/2001 | Kazakos et al. | |
| 6,239,411 | B1 * | 5/2001 | Ito | 399/333 |
| 6,289,198 | B1 * | 9/2001 | Kawamura et al. | 399/333 |
| 6,470,167 | B2 * | 10/2002 | Hwang | 399/333 |

FOREIGN PATENT DOCUMENTS

| | | |
|---|---|---|
| JP | 07-129011 | 5/1995 |
| JP | 10-293491 | 11/1998 |
| JP | 2006-208819 | 8/2006 |
| KR | 1020010085213 A | 9/2001 |
| KR | 1020070062860 A | 6/2007 |

* cited by examiner

*Primary Examiner* — Sandra Brase
(74) *Attorney, Agent, or Firm* — Cantor Colburn LLP

(57) ABSTRACT

A heating member includes a weight supporter having an outer circumference, and a resistive heating disposed on the outer circumference of the weight supporter. The resistive heating layer includes a conductive filler dispersed in a base material. A pair of electrodes extends along a length direction of a rotational axis of the weight supporter and is arranged along a circumference of the weight supporter for supplying electric power to the resistive heating layer.

24 Claims, 6 Drawing Sheets

HEATING MEMBER INCLUDING RESISTIVE HEATING LAYER AND FUSING DEVICE COMPRISING THE HEATING MEMBER

CROSS-REFERENCE TO RELATED APPLICATIONS

This application claims priority to Korean Patent Application No. 10-2009-0031927, filed on Apr. 13, 2009, and all the benefits accruing therefrom under 35 U.S.C. §119, the content of which in its entirety is herein incorporated by reference.

BACKGROUND

1. Field

Disclosed herein is a heating member, which includes a resistive heating layer and a fusing device, which fuses toner onto a printing medium by using the heating member.

2. Description of the Related Art

Electrophotography type image forming apparatus generally supply a toner to an electrostatic latent image disposed on an image receiving body to form a visible toner image on the image receiving body, transfer the toner image onto a printing medium, and fuse the transferred toner image onto the printing medium. The toner is fabricated by adding various functional additives to a base resin. The fusing process includes heating and compressing the toner. A large amount of energy is consumed during the fusing process, which is undesirable.

A fusing device includes a heating roller and a compressing roller that are opposedly disposed to each other and engaged with each other to form a fusing nip. The heating roller may be heated by a heating source such as a halogen lamp. During printing, a medium on which the toner image is transferred is transmitted through the fusing nip, where heat and pressure are then applied to the toner image.

SUMMARY

Disclosed herein is a heating member, which includes a resistive heating layer and a fusing device, which includes the heating member. One or more embodiments also include a heating member, which may have a resistive heating layer that has a reduced electrical resistance and a fusing device, which includes the heating member.

Additional aspects will be set forth in part in the description which follows and, in part, will be apparent from the description, or may be learned by practice of the presented embodiments.

Disclosed herein too is a heating member, which includes a weight supporter having an outer circumference; a resistive heating layer formed by distributing electrically conductive filler into a base material; the resistive heating layer being disposed on the outer circumference of the weight supporter; and a pair of electrodes that extend along a direction of a rotational axis of the weight supporter and are arranged along a circumference of the weight supporter and are operative to supply electric power to the resistive heating layer.

Disclosed herein too is a fusing device, which includes a heating member; and a compressing member opposedly disposed to the heating member to form a fusing nip, wherein the fusing device fuses toner onto a medium that passes through the fusing nip by heating and compressing the toner.

The pair of electrodes may be symmetrically arranged with respect to each other based on the rotational axis of the weight supporter. A plurality of the resistive heating layers may be sequentially stacked on the outer circumference of the weight supporter; and a plurality of pairs of the electrodes may supply electric power to the plurality of resistive heating layers, respectively. An Insulating layer may be disposed between the plurality of the resistive heating layers.

A plurality of the pairs of electrodes may be arranged along the circumference of the resistive heating layers. The intervals between the electrodes may be periodic.

In one embodiment, a part of the pair of electrodes may be buried in the resistive heating layer. A thickness of the part of the pair of electrodes buried in the resistive heating layer may be about half the thickness of the resistive heating layer or less.

The resistive heating layer may have an electric conductivity of $10^5$ Siemens per meter ("S/m") or greater.

The heating member may further include an insulating layer disposed between the weight supporter and the resistive heating layer.

The pair of electrodes may be formed of a material having an electric conductivity of 100 S/m or greater.

The heating member may further include an elastic layer formed of an elastic material.

BRIEF DESCRIPTION OF THE DRAWINGS

The above and other aspects, advantages and features of this disclosure will become more apparent by describing in further detail exemplary embodiments thereof with reference to the accompanying drawings, in which.

DETAILED DESCRIPTION

Figure 1:
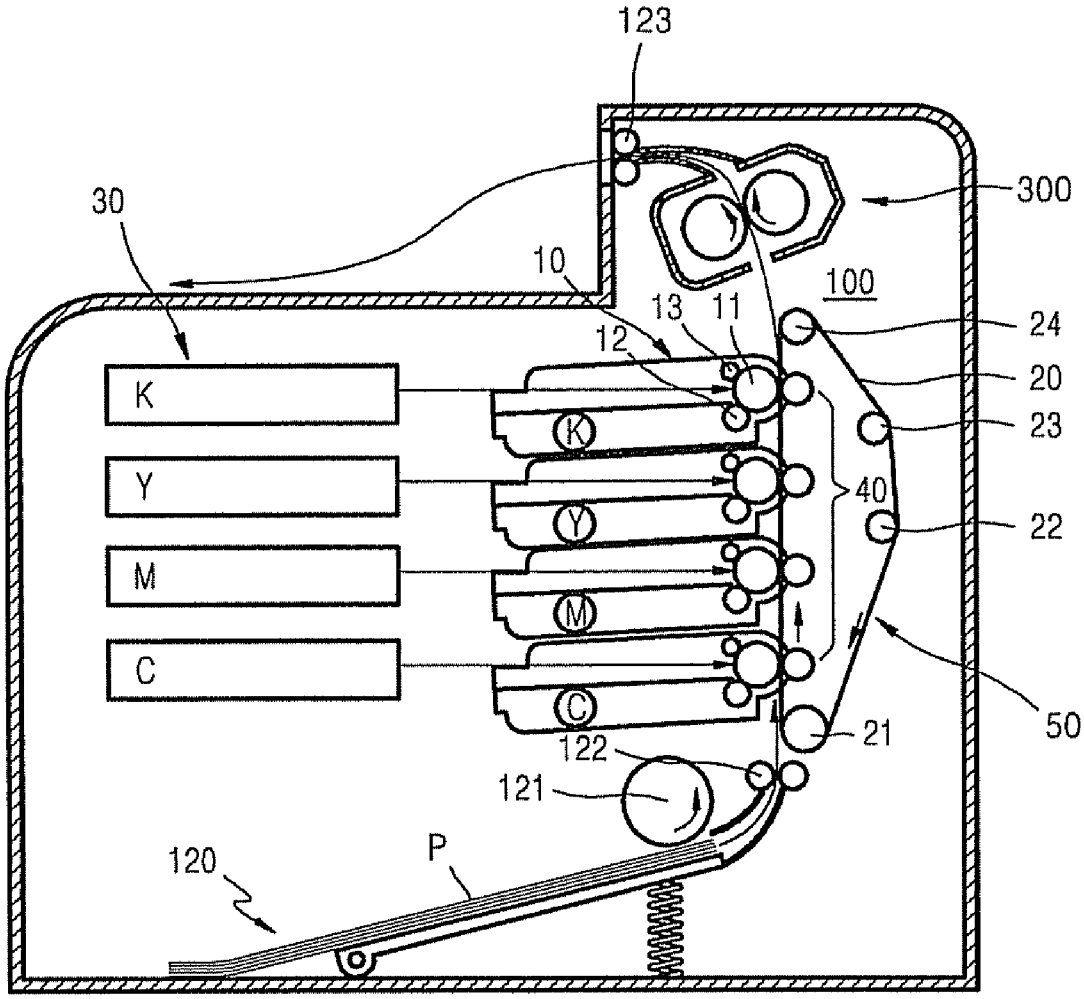
FIG. 1 is an exemplary block diagram of an electrophotography type image forming apparatus.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described, as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The transition term "comprising" may be replaced by the transition terms "consisting of" or "consisting essentially of" when desired.

FIG. 1 is an exemplary block diagram of an electrophotography type image forming apparatus adopting a heating member and a fusing device. Referring to FIG. 1, the image forming apparatus includes a printing unit 100 that is operative to print images onto printing media using an electrophotography processes, and a fusing device 300. The image forming apparatus illustrated in FIG. 1 may be a dry electrophotography type image forming apparatus that can be used for printing color images using a dry developer (hereinafter, the dry developer will be referred to as "toner").

The printing unit 100 includes an exposure unit 30, a developer 10, and a transfer unit 50. The printing unit 100 may include four developers 10C, 10M, 10Y, and 10K, wherein each developer receives a different color toner, for example, cyan (C), magenta (M), yellow (Y), or black (K), and four exposing units 30C, 30M, 30Y, and 30K, each of which corresponds to the developers 10C, 10M, 10Y, and 10K, respectively.

Each of the developers 10C, 10M, 10Y, and 10K includes a photosensitive drum 11 that is an image receiving body on which an electrostatic latent image is formed. Each of the developers 10C, 10M, 10Y, and 10K also includes a developing roller 12 for developing the electrostatic latent image. A charging bias is applied to a charging roller 13 in order to charge an outer circumference of the photosensitive drum 11 to a uniform electric potential. Alternatively, instead of using the charging roller 13, a corona charger (not shown) may be used. The developing roller 12 supplies toner to the photosensitive drum 11 by attaching the toner onto an outer circumference of the developing roller 12. A developing bias is applied to the developing roller 12 to supply the toner to the photosensitive drum 11. Although it is not shown in the drawings, each of the developers 10C, 10M, 10Y, and 10K may further include a supplying roller that is operative to attach toner onto the developing roller 12, a regulating unit that is operative to regulate the amount of toner attached onto the developing roller 12, and an agitator (not shown) that is operative to convey toner received in a corresponding one of the developers 10C, 10M, 10Y, or 10K toward the supplying roller and/or the developing roller 12. In addition, each of the developers 10C, 10M, 10Y, and 10K may further include a cleaning blade that is operative to facilitate removing any extra toner remaining on the outer circumference of the photosensitive drum 11 before charging the photosensitive drum 11, and a receiving space for receiving the removed toner.

As an example, the transfer unit 50 may include a paper conveying belt 20 and four transfer rollers 40. The paper conveying belt 20 faces the outer circumferences of the photosensitive drums 11, which are exposed outside the developers 10C, 10M, 10Y, and 10K. The paper conveying belt 20 is supported by supporting rollers 21, 22, 23, and 24, which permit the supporting rollers 21, 22, 23 and 24 to rotate around the rollers. The four transfer rollers 40 are opposedly disposed with regard to the photosensitive drums 11 of the developers 10C, 10M, 10Y, and 10K with the paper conveying belt 20 interposed therebetween. A transfer bias is applied to the transfer rollers 40.

The exposure units 30C, 30M, 30Y, and 30K scan light that corresponds to image information of cyan, magenta, yellow and black color, respectively, onto the photosensitive drum 11 of each of the developers 10C, 10M, 10Y, or 10K, respectively. In the present embodiment, a laser scanning unit that uses a laser diode as a light source is used as the exposure unit 30C, 30M, 30Y, and 30K respectively.

A process of forming a color image using the above structure will be described as follows.

The photosensitive drum 11 in each of the developers 10C, 10M, 10Y, and 10K is charged to have a uniform electric potential because of the charging bias applied by the charging roller 13. The four exposure units 30C, 30M, 30Y, and 30K scan light corresponding to the image information of cyan, magenta, yellow, and black colors, respectively, onto the photosensitive drums 11 of the developers 10C, 10M, 10Y, and 10K, respectively, to form electrostatic latent images. The developing bias is applied to the developing rollers 12. Then, toner is attached onto the outer circumferences of the developing rollers 12 and is transferred onto the electrostatic latent images so that toner images of cyan, magenta, yellow, and black colors are disposed on the photosensitive drums 11 of the developers 10C, 10M, 10Y, and 10K.

A medium that is to receive the toner, for example, paper P, is drawn from a cassette 120 by a pickup roller 121. The paper P is transferred onto the paper conveying belt 20 by conveying rollers 122. The paper P adheres to the paper conveying belt 20 due to electrostatic forces and travels with the same velocity as the traveling velocity of the paper conveying belt 20.

For example, a front edge of the paper P reaches the transfer nip at the time as when the front edge of the toner image of cyan color, which is disposed on the outer circumference of the photosensitive drum 11 in the developer 10C, reaches the same transfer nip. The transfer nip is formed at the portion where the first of the photosensitive drums 11 faces the first of the transfer rollers 40 proximate to the supporting roller 21. When the transfer bias is applied to the transfer rollers 40 corresponding to the photosensitive drum 11 (corresponding to the toner image of cyan color), the cyan toner image disposed on the photosensitive drum 11 is transferred onto the paper P. As the paper P is conveyed towards the fusing device 300, the toner images of magenta M, yellow Y, and black K colors disposed on the photosensitive drums 11 of the developers 10M, 10Y, and 10K are sequentially transferred onto the paper P and overlap each other. Accordingly, a color toner image may be disposed on the paper P.

The color toner image disposed on the paper P is maintained on the surface of the paper P due to static electricity. The fusing device 50 fuses the color toner image on to the paper P using heat and pressure. The paper P on which the color toner image is fused is discharged out of the image forming apparatus by discharging rollers 123.

Figure 2:
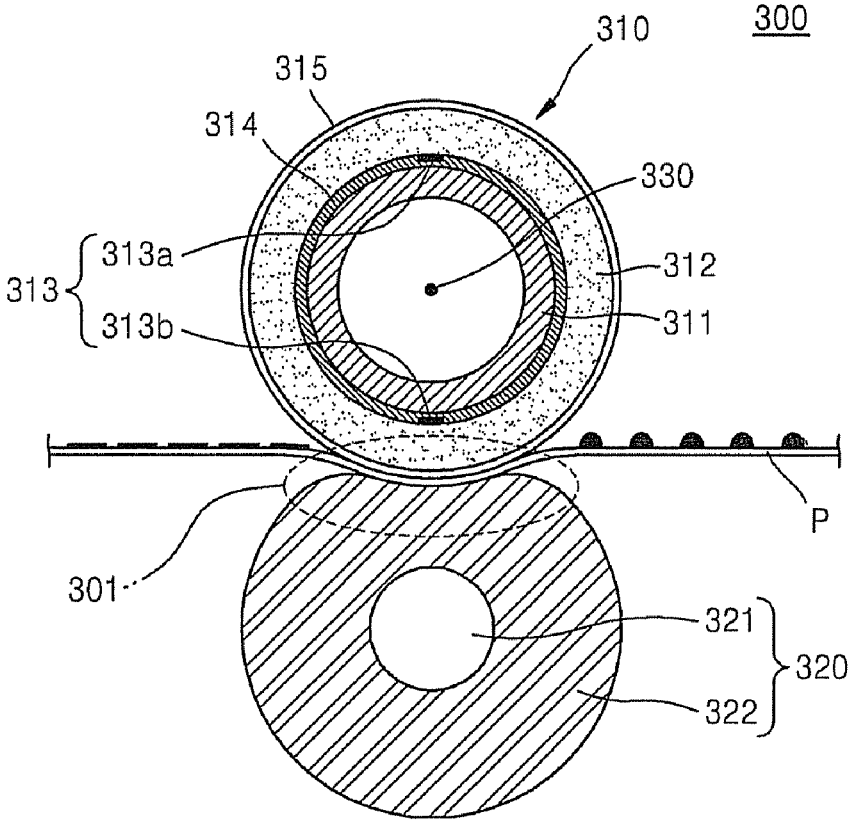
FIG. 2 is an exemplary longitudinal cross-sectional view of a fusing device.

FIG. 2 is an exemplary longitudinal cross-sectional view of a fusing device 300 adopted in the image forming apparatus illustrated in FIG. 1. Referring to FIG. 2, a heating member 310, which is formed as a roller, and a compressing member 320 that is opposedly disposed to the heating member 310 functions as a fusing nip 301. The compressing member 320 functions as a roller. In one aspect, the compressing member 320 includes an elastic layer 322, which surrounds a metal core 321. The heating member 310 and the compressing member 320 are biased to press against each other by a bias unit (not shown). An example of the bias unit may be, for example, a spring. When a part of the elastic layer 322 of the compressing member 320 is deformed by the heating member 310, the fusing nip 301 is formed. In forming the fusing nip 301, heat is transferred from the heating member 310 to the toner on the paper P.

The heating member 310 includes a weight supporter 311, a resistive heating layer 312 disposed on an outer circumference of the weight supporter 311, and a pair of electrodes 313 that are operative to supply electric power to the resistive heating layer 312. The electrode pair 313 includes a first electrode 313*a* and a second electrode 313*b*. The first electrode 313*a* may be an anode, and the second electrode 313*b* may be a cathode.

The weight supporter 311 may include a metal pipe. In this case, an insulating layer 314 may be disposed between the weight supporter 311 and the resistive heating layer 312 in order to electrically insulate the weight supporter 311. The weight supporter 311 may be formed of a high heat-resistant plastic that has excellent mechanical properties at high temperatures, for example, polyphenylene sulfide ("PPS"), polyamideimide, polyimide, polyketone, polyphthalamide ("PPA"), polyether-ether-ketone ("PEEK"), polythersulfone ("PES"), polyetherimide ("PEI"), or the like, or a combination comprising at least one of the foregoing high heat-resistant plastics. Alternatively, the weight supporter 311 may be formed of any material that has stable mechanical properties at those temperatures at which the fusing device is usually used. When an electrically non-conductive material such as a high heat-resistant plastic is used as the weight supporter 311, the insulating layer 314 may be not used because of the electrically insulating properties provided by the high heat-resistant plastic in the weight supporter 311.

When an electrically conducting material is used as the weight supporter 311, an insulating layer is desired in order to prevent electrical shorting between the electrodes 313*a*, 313*b* and the weight supporter 311. The insulating layer may also be formed of polymers having electrically insulating properties. A high heat-resistant plastic, such as those listed above, may also be used to form the insulating layer 314. In one aspect, a foamed polymer may be used to form the insulating layer 314 so that the insulating layer 314 may have thermal insulating properties.

A release layer 315 may be used as the outermost layer of the heating member 310 for preventing offsetting of toner. In other words, by using a release layer 315, as the outermost layer of the heating member 310, toner on the paper P is prevented from being transferred and affixed onto a surface of the heating member 310. The release layer 315 may be formed of a fluoropolymer-based material such as polytetrafluoroethylene ("PTFE") or a silicon based material such as polydimethylsiloxane ("PDMS"). Copolymers of PTFE or PDMS may also be used.

In the fusing device 300, the heating member 310 uses the resistive heating layer 312 as a heat source. The resistive heating layer 312 is formed by dispersing electrically conductive filler into a base material. The base material may be any kind of material that displays thermal resistance and heat stability at the fusing temperature. In addition, the base material may be an elastic material (e.g., an elastomer).

For example, a high heat-resistant elastomer, such as, for example, a silicon based rubber (e.g., polydimethylsiloxane), may be the base material of the resistive heating layer 312. When a voltage is applied to the resistive heating layer 312, Joule heating is generated in the resistive heating layer 312. The conductive filler may be a metal-based filler such as iron, nickel, aluminum, gold, silver, or the like, or a combination comprising at least one of the foregoing metal-based fillers. In one aspect, the electrically conducting filler may be a carbon-based filler such as carbon black, chopped carbon-fiber, carbon nanotubes (single wall carbon nanotubes, multiwall carbon nanotubes) carbon filament, carbon coil, or the like, or a combination comprising at least one of the foregoing carbon-based fillers. Combinations of the metal-based fillers and the carbon-based fillers may also be used.

The metal-based filler and the carbon based filler may be formed to have various shapes, for example, may be needleshaped, plate-shaped, particulate-like or spherical. In addition, in order to improve thermal conductivity, a metal oxide such as alumina or oxidized steel may be added into the resistive heating layer 312.

In order to form images, the fusing device 300 is heated to a temperature around the fusing temperature. When the time period for heating the fusing device 300 to the fusing temperature is reduced, the period between receiving a printing command and printing the first page may also be reduced. In other words, improving the heating efficiency of the fusing device 300 improves printing efficiency. In a general electrophotography type image forming apparatus, the fusing apparatus is only heated when a printing operation is performed, i.e., when an image is printed. The fusing apparatus does not operate in the standby mode, i.e., it does not operate when no printing is being performed. Therefore, when printing is to be performed at intervals of time apart, the fusing device has to be re-heated. In order to reduce the time needed to re-heat the fusing device 300, the fusing device 300 is controlled so as to remain at a selected preheating temperature when in the standby mode. A suitable preheating temperature (of the fusing device in the standby mode) is about 150° C. to about 180° C. For example, in the image forming apparatus for printing images onto papers of A4 size, power consumption during the standby mode is about 30 watts ("W"). If the time for raising the temperature of the fusing device (to the temperature at which the printing operation may be performed) is sufficiently reduced, then preheating in the standby mode may be not performed and accordingly power consumption may be reduced.

The temperature generated from the resistive heating layer 312 and the rate at which the temperature is increased may be determined by the physical properties of the resistive heating layer 312. Examples of such physical properties are geometric dimensions such as a thickness and length, specific heat, and electric conductivity of the resistive heating layer 312. The resistive heating layer 312 may have an electric conductivity of $10^{-5}$ S/m or greater. When the resistance of the resistive heating layer 312 is small, the heating member 310 may be rapidly heated at a high efficiency. Resistance ("R") of the resistive material is proportional to a length of the resistive material, and is inversely proportional to the cross-sectional area and the electric conductivity of the resistive material. In order to reduce the resistance of the resistive heating layer 312, the electric conductivity may be increased.

The electric conductivity may be increased by increasing the content of conductive filler, improving the arrangement of the filler, and/or controlling the dispersion of the filler. However, increasing the filler content may degrade physical properties of the resistive heating layer 312, and accordingly, may reduce the lifespan of the heating member 310. Therefore, there are limitations on increasing the filler content in the resistive heating layer 312. While, the electrical conductivity of the resistive heating layer 312 may be increased by improving the arrangement of the filler and controlling the dispersion of the filler without increasing the filler content, there are limitations on increasing the electric conductivity of the filler.

In order to work around the limitations in filler electrical conductivity, the length of the resistive material may be reduced. Here, the length of resistive material denotes a length of a path in which electric current flows, and thus, the first and second electrode 313*a* and 313*b* may be disposed so that electric current may flow along a short path in the resistive heating layer 312. Since the heating member 310 is in the shape of a roller, it may have a length (measured along the circumference) that is shorter than the length of the heating member 310 along the direction of the rotational axis 330 (also known as the "length direction"). If the electrical current flows along the circumference in the resistive heating layer 312 instead of along the length of the rotational axis 330, the length of the path through which the electric current flows may be reduced. To do this, as shown in FIGS. 2 and 3, the first and second electrodes 313*a* and 313*b* extend along a direction of the rotational axis 330 of the heating member 310, and are arranged along the circumference of the heating member 310.

Figure 4:
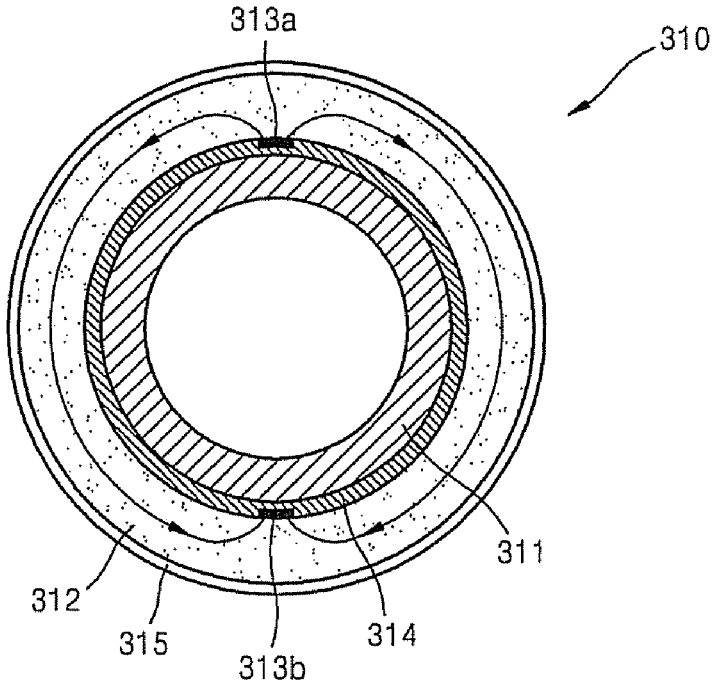
FIG. 4 is an exemplary diagram showing a flow of electric current in a resistive heating layer of the fusing device illustrated in FIG. 2.

When a voltage V is applied to the first and second electrodes 313*a* and 313*b*, the electric current flows in the circumference in the resistive heating layer 312 as shown in FIG. 4. The first and second electrodes 313*a* and 313*b* may be symmetrical with each other based on the rotational axis 330 of the heating member 310 in order to generate heat evenly on all areas of the resistive heating layer 312.

Figure 3:
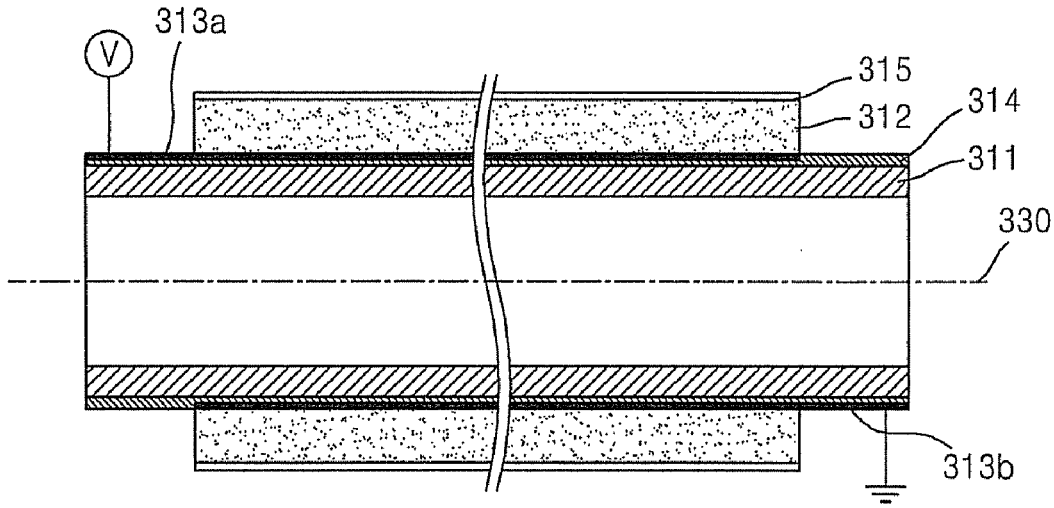
FIG. 3 is an exemplary transverse cross-sectional view of the fusing device illustrated in FIG. 2.

To demonstrate the advantage of placing the electrodes as depicted in the FIGS. 2, 3 and 4, the resistance of the resistive heating layer 312 when disposed on a cylindrical pipe is measured in two different ways. A first resistance measurement was made on the resistive heating layer 312 when the electrodes are placed on opposing ends along the length direction of the resistive heating layer 312. A second resistance measurement was made with the electrodes placed along the length of the resistive heating layer 312 as depicted in the FIGS. 2, 3 and 4. The resistive heating layer 312 has an electric conductivity of 10 S/m, a length of 23 centimeter ("cm"), a thickness of 0.2 millimeters ("mm"), and an outer diameter of 2.3 cm. The resistance of the resistive heating layer 312 in the former case is about 1.6 kilo-ohm ("kΩ"), and the resistance of the resistive heating layer 312 in the latter case is about 80 ohm ("Ω"), which is much lower than that of the former case.

In another example, a carbon-based filler may be added to PDMS to form a resistive heating layer having a thickness of about 0.55 mm, a length of about 29 cm, and a width of about 10 cm, and the resistive heating layer is wound on a cylindrical pipe to form the resistive heating layer 312. The resistance of the resistive heating layer is measured in the case where the electrode pairs 313 are formed on ends along the length direction of the resistive heating layer 312 and in the case where the electrode pairs 313 extending along the length direction and arranged along the circumference of the resistive heating layer 312. The resistance of the resistive heating layer 312 is about 8,000 Ω in the former case, and the resistance of the resistive heating layer 312 is about 780 Ω in the latter case. Thus, as seen from the above examples, when the electric current flows in the circumferential direction as shown in the FIGS. 2 and 3, the resistance of the heating layer is significantly reduced.

As described above, the electrode pair 313 is disposed such that electric current may flow in a circumferential direction along the resistive heating layer 312 in order to reduce the resistance of the resistive heating layer 312, and accordingly, the heating member 310 may generate heat rapidly at high efficiencies with regard to given conditions of the conductive filler content. In addition, degradation in the heating characteristics of the resistive heating layer 312 is reduced, and the content of the conductive filler added in the resistive heating layer 312 may be adjusted to be within a range in which the physical properties of the resistive heating layer 312, such as a stiffness, a tensile strength, and a compressive strength, may be suitable for the fusing device. In addition, the amount of conductive filler may be adjusted so that the physical properties of the resistive heating layer 312 may be maintained so as to be easily processable by general fabrication methods, such as injection molding, extrusion, dipping or spray coating, while maintaining the heating properties of the resistive heating layer 312.

A metal having relatively high electric conductivity may be used to form the electrode pair 313. However, other electrically conductive materials may be used in the electrode pair 313. For example, a ceramic having excellent electric conductivity such as indium tin oxide ("ITO"), indium zinc oxide ("IZO"), tin oxide ("SnO"), or the like, or a combination comprising at least one of the foregoing ceramics, can be used. In particular, indium tin oxide can be used to form transparent electrodes. Electrically conducting polymers, such as, for example, poly-3, 4-ethylenedioxythiophene ("PEDOT"), polypyrrole ("PPy"), polyaniline, polyacetylene, or the like, or a combination comprising one of the foregoing electrically conducting polymers can also be used in the electrodes. Carbonaceous materials such as carbon nano-tubes, carbon fibers, carbon nano-fibers, carbon filaments, carbon coils, carbon blacks, or the like, or a combination comprising at least one of the foregoing carbonaceous materials may also be used as materials for the electrode pair 313.

Figure 5:
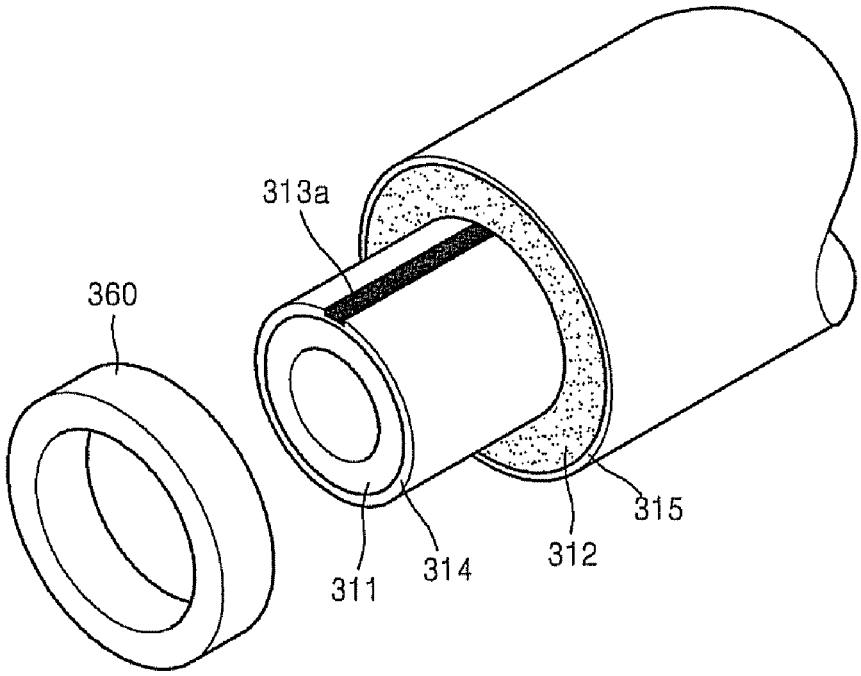
FIG. 5 is an exemplary perspective view of a connecting structure between a first electrode and a power supplying device in the fusing device.

An exemplary structure for connecting the first electrode 313*a* to a power supply apparatus (not shown) is a ring member 360 that is formed of an electrically conductive material and is inserted into an end portion of the heating member 310. The ring member 360 may be electrically connected to the power supply apparatus (not shown), as depicted in the FIG. 5. The second electrode 313*b* may be also connected to the power supply apparatus (not shown) by the same structure as depicted in the FIG. 5. The connecting structure shown in FIG. 5 is an example.

Figure 6:
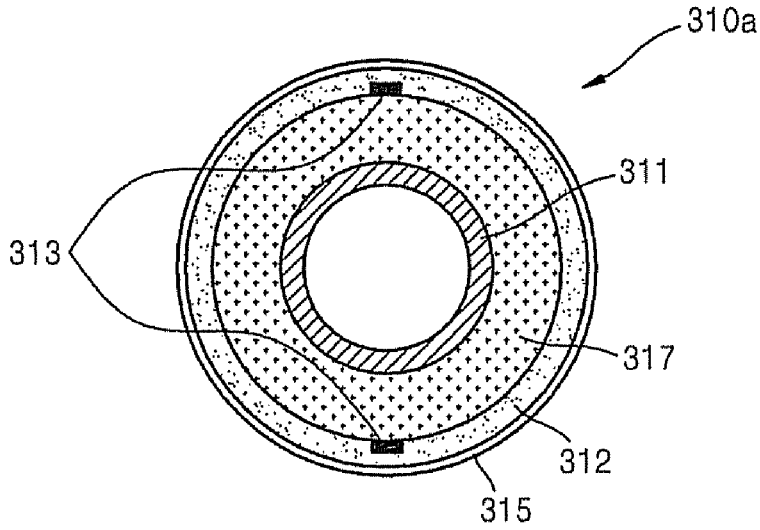
FIG. 6 is an exemplary longitudinal cross-sectional view a heating member including an additional elastic layer.

The heating member 310 may include an elastic layer. As noted above, the elastic layer can include an elastomer. For example, when a heat-resistant polymer is used as the base material of the resistive heating layer 312, the resistive heating layer 312 may be the elastic layer. In addition, when an elastic polymer is used as a material in the insulating layer 314, the insulating layer 314 may be the elastic layer. In addition, an additional elastic layer 317 may be disposed between the resistive heating layer 312 and the weight supporter 311 as shown in a heating member 310*a* of FIG. 6.

Figure 7:
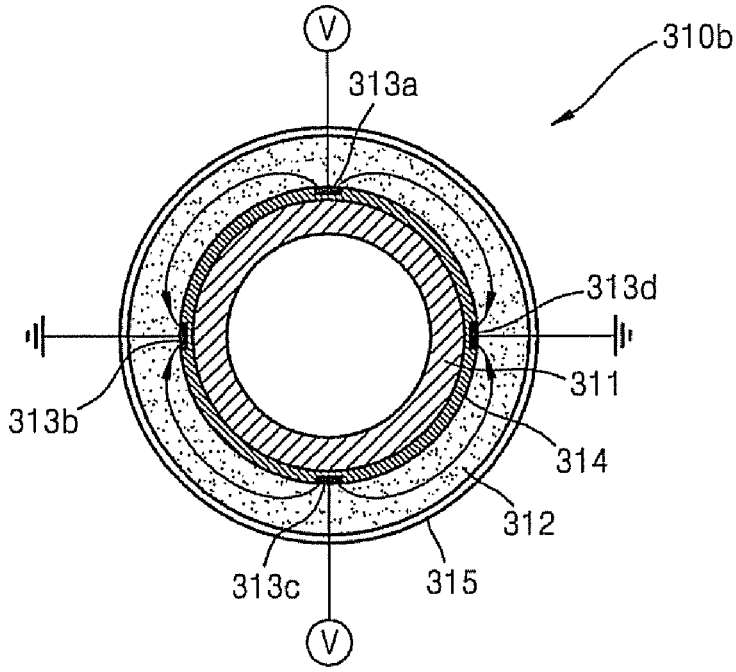
FIG. 7 is an exemplary cross-sectional view of a heating member including a plurality of electrode pairs.

FIG. 7 shows a heating member 310*b* according to another embodiment. Referring to FIG. 7, the heating member 310*b* includes a plurality of first electrodes 313*a* and 313*c* and a plurality of second electrodes 313*b* and 313*d* arranged along the circumference of the heating member 310*b*. The first electrodes 313*a* and 313*c* and the second electrodes 313*b* and 313*d* are alternately arranged along the circumference of the heating member 310*b*. When the pluralities of first electrodes 313*a* and 313*c* and second electrodes 313*b* and 313*d* are formed, a path through which electric current flows in the heating member 310*b* may be reduced. While the heating member 310*b* of FIG. 7 includes two pairs of electrodes, the heating member may include three or more electrode pairs. Intervals between the electrodes may be constant (i.e., the electrode pairs may be periodically distributed) in order to generate heat evenly to all portions of the resistive heating layer 312. However, intervals between the electrodes may also not be constant (i.e., the electrode pairs may be aperiodically distributed) according to conditions, such as shapes of the electrodes and sizes of the electrodes.

Figure 8:
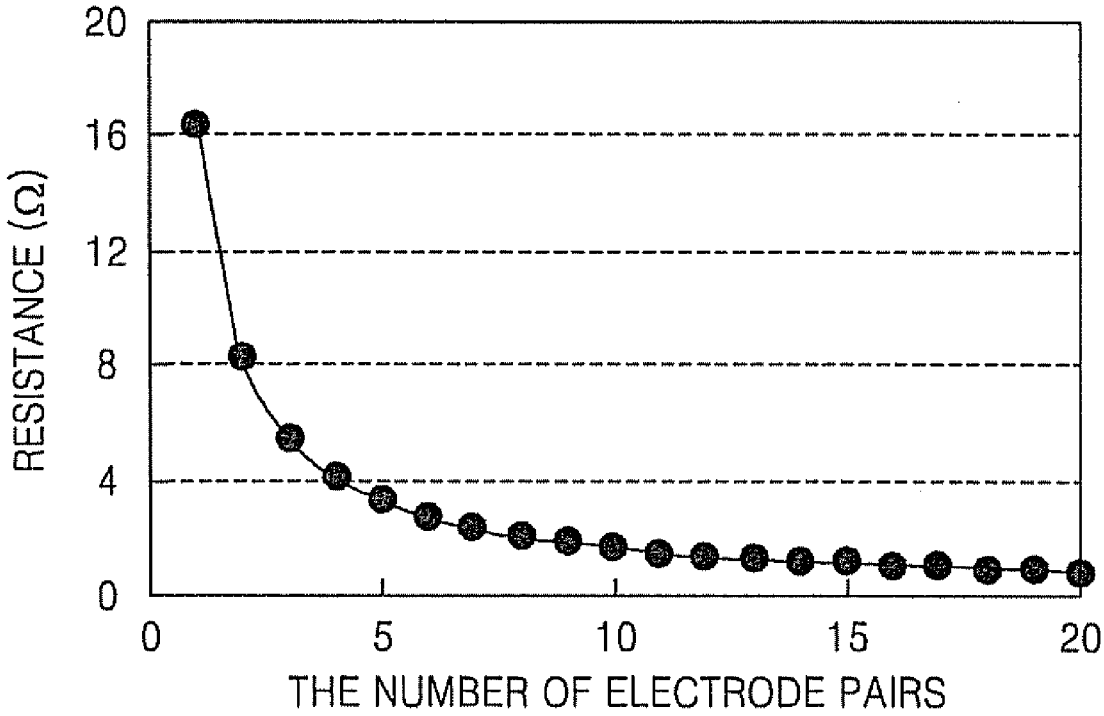
FIG. 8 is a graph illustrating a resistance between electrode pairs versus the number of electrode pairs.

FIG. 8 is a graph that shows resistances between electrode pairs when a plurality of electrode pairs that extend along a length direction of the resistive heating layer and are arranged along the circumference are installed in the resistive heating layer 312 having an electric conductivity of 10 S/m, a length of 23 cm, a thickness of 0.2 mm, and an outer diameter of 2.3 cm. In FIG. 8, it may be seen that the more electrode pairs there are, the less the resistance between the electrode pairs becomes.

Figure 9:
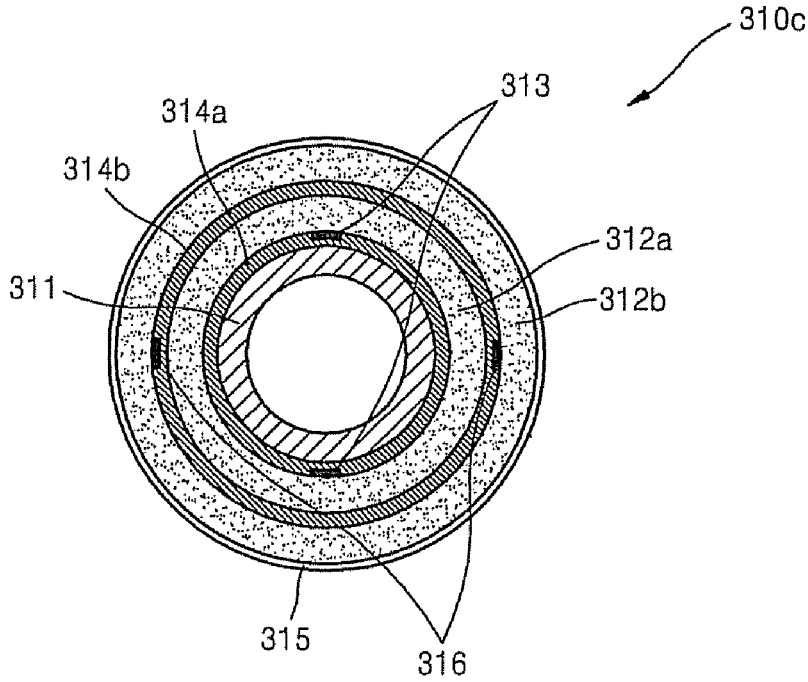
FIG. 9 is an exemplary cross-sectional view of a heating member including a plurality of resistive heating layers.

FIG. 9 shows a heating member 310*c* according to another exemplary embodiment. The heating member 310*c* illustrated in FIG. 9 is different from the heating member 310 illustrated in FIG. 2 in that the heating member 310*c* includes two resistive heating layers 312*a* and 312*b* stacked along a radial direction of the heating member 310*c*. Two electrode pairs 313 and 316 apply voltages to the resistive heating layers 312*a* and 312*b*, respectively. An insulating layer 314*a* electrically isolates the resistive heating layer 312*a* from the weight supporter 311, and an insulating layer 314*b* electrically isolates the resistive heating layers 312*a* and 312*b* from each other. In order to increase thermal conductivity, a metal oxide such as alumina or oxidized steel may be added in the insulating layer 314*b*. In the present embodiment, the heating member 310*c* includes two resistive heating layers 312*a* and 312*b*, however, the heating member may include three or more resistive heating layers if desired. In addition, the electrode pairs for applying voltages to the resistive heating layers may include a plurality of electrode pairs as shown previously in the FIG. 7.

Figure 10:
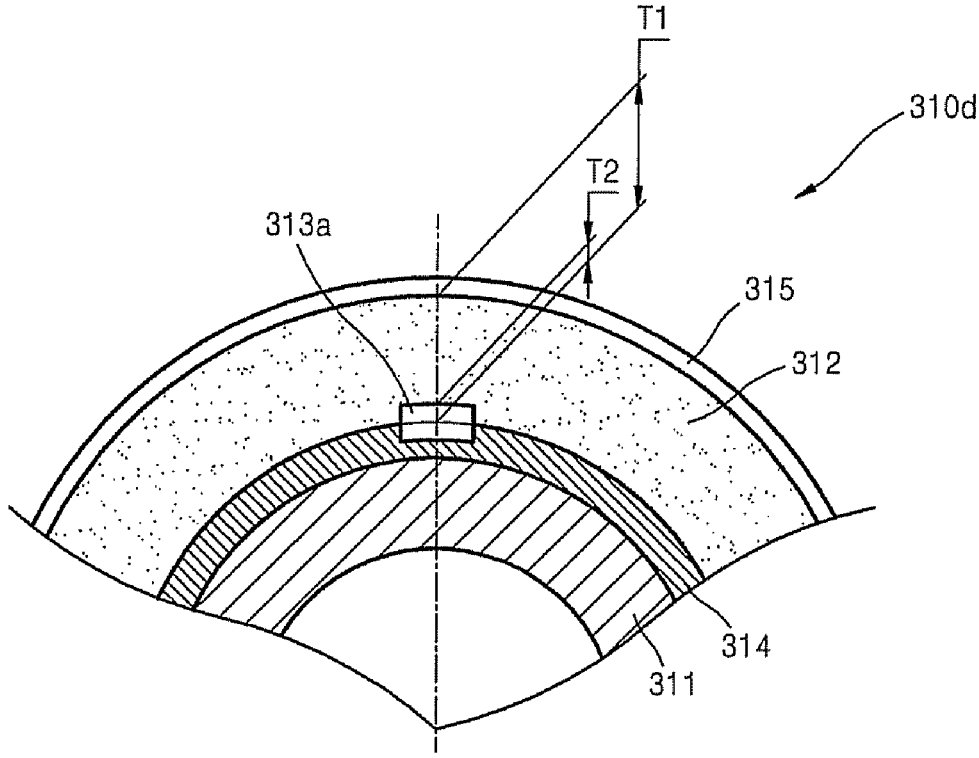
FIG. 10 is an exemplary cross-sectional view of a heating member including electrode pairs, some parts of which are buried in a resistive heating layer.

FIG. 10 shows a heating member 310*d* according to another exemplary embodiment. The heating member 310*d* illustrated in FIG. 10 is different from the heating member 310 of FIG. 2 in that a part of electrode pair 313*a* is buried in the resistive heating layer 312. According to the structure shown in FIG. 10, the resistance may be reduced by increasing contact area between the electrode pair 313*a* and the resistive heating layer 312, and excellent heating properties may therefore be realized. The heating member 310*d* displays robust performance against pressure generated by repeated fusing operations and compression by the compressing member 320. When a thickness T2 of the portion of the electrode pair 313 that is buried in the resistive heating layer 312 is excessively large, the portion of the resistive heating layer 312 around the electrode pair 313 may be degraded. In addition, the portion of the resistive heating layer 312 that is adjacent to the electrode pair 313 may get overheated. Therefore it is desirable for the thickness T2 of the part of the electrode pair 313*a* that is buried in the resistive heating layer 312 to be about ½ of the thickness T1 of the resistive heating layer 312 or less.

It should be understood that the exemplary embodiments described therein should be considered in a descriptive sense only and not for purposes of limitation. Descriptions of features or aspects within each embodiment should typically be considered as available for other similar features or aspects in other embodiments.

In addition, while the exemplary embodiments have been particularly shown and described herein, it will be understood by those of ordinary skill in the art that various changes in form and details may be made therein without departing from the spirit or scope of the present invention as defined by the following claims.

What is claimed is:

1. A heating member comprising:

a cylindrical weight supporter;

a resistive heating layer formed by distributing electrically conductive filler into a base material, the resistive heating layer being disposed on an outer circumference of the weight supporter; and a pair of electrodes to supply electric power to the resistive heating layer, wherein the electrodes extend along a direction of a rotational axis of the weight supporter and are arranged to be spaced apart from each other along a circumferential direction of the weight supporter.

2. The heating member of claim 1, wherein the pair of electrodes are arranged to be symmetrical with each other based on the rotational axis of the weight supporter.

3. The heating member of claim 2, wherein a plurality of the resistive heating layers are sequentially stacked on the outer circumference of the weight supporter; and a plurality of pairs of the electrodes supply electric power to the plurality of the resistive heating layers, respectively.

4. The heating member of claim 3, wherein an insulating layer is disposed between the plurality of the resistive heating layers.

5. The heating member of claim 1, wherein a plurality of the pairs of electrodes is arranged along a circumference of the resistive heating layers.

6. The heating member of claim 5, wherein intervals between the electrodes are uniform.

7. The heating member of claim 1, wherein a part of the pair of electrodes is buried in the resistive heating layer.

8. The heating member of claim 7, wherein a thickness of the part of the pair of electrodes buried in the resistive heating layer is about half the thickness of the resistive heating layer or less.

9. The heating member of claim 1, wherein the resistive heating layer has an electric conductivity of $10^{-5}$ Siemens per meter or greater.

10. The heating member of claim 1, further comprising an insulating layer disposed between the weight supporter and the resistive heating layer.

11. The heating member of claim 1, wherein the pair of electrodes is formed of a material having an electric conductivity of 100 Siemens per meter or greater.

12. The heating member of claim 1, further comprising an elastic layer formed of an elastic material.

13. A fusing device comprising:

a heating member; the heating member comprising:

a cylindrical weight supporter;

a resistive heating layer formed by distributing electrically conductive filler into a base material; the resistive heating layer being disposed on an outer circumference of the weight supporter; and a pair of electrodes to supply electric power to the resistive heating layer, the electrodes extending along a direction of a rotational axis of the weight supporter and arranged to be spaced apart from each other along a circumferential direction of the weight supporter; and a compressing member facing the heating member to form a fusing nip, wherein the fusing device fuses toner onto a medium that passes through the fusing nip by heating and compressing the toner.

14. The fusing device of claim 13, wherein the pair of electrodes are arranged to be symmetrical with each other based on the rotational axis of the weight supporter.

15. The fusing device of claim 14, wherein a plurality of the resistive heating layers are sequentially stacked on the outer circumference of the weight supporter; and a plurality of the pairs of electrodes supply electric power to the plurality of resistive heating layers, respectively.

16. The fusing device of claim 15, wherein an insulating layer is disposed between the plurality of the resistive heating layers.

17. The fusing device of claim 13, wherein a plurality of the pairs of electrodes are arranged along a circumference of the resistive heating layers.

18. The fusing device of claim 17, wherein intervals between the electrodes are uniform.

19. The fusing device of claim 13, wherein a part of each of the pair of electrodes is buried in the resistive heating layer.

20. The fusing device of claim 19, wherein a thickness of the part of the pair electrodes buried in the resistive heating layer is about half the thickness of the resistive heating layer or less.

21. The fusing device of claim 13, wherein the resistive heating layer has an electric conductivity of $10^{-5}$ Siemens per meter or greater.

22. The fusing device of claim 13, further comprising an insulating layer disposed between the weight supporter and the resistive heating layer.

23. The fusing device of claim 13, wherein the pair of electrodes is formed of a material having an electric conductivity of 100 Siemens per meter or greater.

24. The fusing device of claim 13, wherein the heating member includes an elastic layer.

* * * * *